US010316557B2

(12) United States Patent
Hartz et al.

(10) Patent No.: US 10,316,557 B2
(45) Date of Patent: Jun. 11, 2019

(54) LATCH SYSTEM FOR HOOD OF A MACHINE

(71) Applicant: Caterpillar Inc., Peoria, IL (US)

(72) Inventors: Phillip A. Hartz, Sugar Grove, IL (US); Gerald W. Gavin, Hinckley, IL (US); Daniel A. Hatfield, Rochelle, IL (US); Brian P. Budzynski, Oswego, IL (US); Christopher M. Runestad, North Aurora, IL (US)

(73) Assignee: Caterpillar Inc., Deerfield, IL (US)

( * ) Notice: Subject to any disclaimer, the term of this patent is extended or adjusted under 35 U.S.C. 154(b) by 1103 days.

(21) Appl. No.: 14/601,706

(22) Filed: Jan. 21, 2015

(65) Prior Publication Data

US 2016/0208528 A1 Jul. 21, 2016

(51) Int. Cl.

| | |
|---|---|
| ***E05B 3/00*** | (2006.01) |
| ***E05C 17/02*** | (2006.01) |
| ***E05B 83/00*** | (2014.01) |
| ***E05C 19/00*** | (2006.01) |
| ***E05F 7/04*** | (2006.01) |
| ***E02F 9/08*** | (2006.01) |

(52) U.S. Cl.

CPC ..... *E05C 17/02* (2013.01); *E02F 9/0833* (2013.01); *E02F 9/0891* (2013.01); *E05B 83/00* (2013.01); *E05C 19/00* (2013.01); *E05F 7/04* (2013.01)

(58) Field of Classification Search

CPC ..... E05C 19/145; E05C 19/14; Y10S 292/31; Y10S 292/49; Y10T 24/2196; Y10T 292/216

USPC ..... 292/336.3, 346, 351

See application file for complete search history.

(56) References Cited

U.S. PATENT DOCUMENTS

| | | | | |
|---|---|---|---|---|
| 2,618,282 | A | 11/1952 | Stanitz et al. | |
| 4,801,165 | A * | 1/1989 | Pyle | E05C 19/14 292/249 |
| 5,311,756 | A * | 5/1994 | Villani | B60R 25/006 70/202 |
| 5,444,999 | A * | 8/1995 | Hsiao | B60R 25/066 70/202 |
| 6,719,077 | B2 * | 4/2004 | Connett | B62D 25/10 180/69.21 |

(Continued)

FOREIGN PATENT DOCUMENTS

| | | |
|---|---|---|
| GB | 470191 | 8/1937 |
| JP | 10044887 | 2/1998 |

*Primary Examiner* — Mark A Williams

(74) *Attorney, Agent, or Firm* — Calfee, Halter & Griswold LLP

(57) ABSTRACT

An interlock lever for actuating a latch member of a machine is disclosed. The latch member is configured to lock a hood of the machine in a closed position thereof. The machine has an input member being movable in a first direction to move the hood towards an opened position and a second direction to move the hood towards the closed position. The interlock lever includes a body coupled to a frame of the machine and a slot defined in the body. The body is movable between a first position and a second position. In the second position of the body, the slot allows movement of the input member in the first direction and actuates the latch member to allow the hood to move from the closed position. In the first position of the body, the slot prevents movement of the input member in the first direction.

7 Claims, 5 Drawing Sheets

(56) References Cited

U.S. PATENT DOCUMENTS

| | | | | |
|---|---|---|---|---|
| 7,334,497 | B2 * | 2/2008 | Giefer | F16H 59/10<br>74/473.12 |
| 7,405,369 | B2 | 7/2008 | Mukharzi et al. | |
| 8,584,787 | B2 * | 11/2013 | Hwang | B60R 21/38<br>180/274 |
| 8,800,703 | B2 * | 8/2014 | Miller | B62D 25/10<br>180/69.2 |
| 2013/0205848 | A1 * | 8/2013 | Langenberg | E05B 17/183<br>70/455 |

* cited by examiner

LATCH SYSTEM FOR HOOD OF A MACHINE

TECHNICAL FIELD

The present disclosure relates to a latch system for a hood of a machine.

BACKGROUND

The engine compartment of machines, such as mining trucks, wheel loaders, excavators, and the like, is typically enclosed by a hood. The hood is coupled to the frame of the machine and may be operated by an actuator, which may be driven by electric power, hydraulic power or pneumatic power. The hood is moved to an opened position by the actuator for servicing and maintenance of an engine, a radiator or other components disposed in the engine compartment. An operator may activate the actuator to move the hood to the opened position and a closed position. During loading of the machines, especially in the event of vertical loading, the hood may vibrate in the closed position and thereby generate noise. The hood may be constrained in the closed position, but activating the actuator while the hood is restricted to the closed position may cause damage to the actuator.

U.S. Pat. No. 8,584,787 (the '787 patent) discloses an active hood apparatus. The active hood apparatus includes a main frame fixed to a vehicle body. A latch assembly is disposed at a back side of the main frame for locking and releasing a hood. A hood rise and fall device is disposed between the back side of the main frame and the hood latch assembly. The hood rise and fall device moves the hood latch assembly in a vertical direction based on a control signal from a controller. The controller receives a sensing signal from a pedestrian collision sensor. The active hood apparatus is actuated by the control signal from the controller to move the hood from the locked position. However, not all machines include a hood such as in the '787 patent, including latch assemblies that are electronically controlled and receive control signals from a controller. Therefore, a need remains for improvements in this technology area.

SUMMARY OF THE DISCLOSURE

In one aspect of the present disclosure, an interlock lever for actuating a latch member of a machine is provided. The latch member is configured to selectively lock a hood of the machine in a closed position of the hood. The machine has an input member configured to move the hood between the closed position and an opened position. The input member is movable in a first direction to move the hood towards the opened position and a second direction to move the hood towards the closed position. The interlock lever includes a body movable between a first position and a second position. In the second position, the body is configured to actuate the latch member to allow the hood to move from the closed position thereof. The interlock lever further includes a slot defined in the body. In the first position of the body, the slot is configured to prevent movement of the input member in the first direction. In the second position of the body, the slot is configured to allow movement of the input member in the first direction.

In another aspect of the present disclosure, a latch system for a hood of a machine is provided. The machine includes an input member configured to move the hood between a closed position and an opened position. The input member is movable in a first direction to move the hood towards the opened position and a second direction to move the hood towards the closed position. The latch system includes a latch member switchable between a locked configuration and an unlocked configuration. In the locked configuration, the latch member is configured to retain the hood in the closed position thereof. In the unlocked configuration, the latch member is configured to allow movement of the hood from the closed position thereof. The latch system further includes an interlock lever movable between a first position and a second position. In the first position, the interlock lever is configured to prevent the movement of the input member in the first direction. In the second position, the interlock lever is configured to actuate the latch member to the unlocked configuration thereof and allow movement of the input member in the first direction.

In yet another aspect of the present disclosure, a machine is provided. The machine includes a frame, a hood coupled to the frame and movable between an opened position and a closed position, and an actuator for selectively moving the hood between the opened position and the closed position. The machine further includes an input member coupled to the actuator. The input member is configured to actuate the actuator based on a user input. Further, the input member is movable in a first direction to move the hood towards the opened position and a second direction to move the hood towards the closed position. The machine further includes a latch member switchable between a locked configuration and an unlocked configuration. In the locked configuration, the latch member is configured to retain the hood in the closed position thereof. In the unlocked configuration, the latch member is configured to allow movement of the hood from the closed position thereof. The machine further includes an interlock lever movable between a first position and a second position. In the first position, the interlock lever is configured to prevent movement of the input member in the first direction. In the second position, the interlock lever is configured to actuate the latch member to the unlocked configuration thereof and allow movement of the input member in the first direction.

Other features and aspects of this disclosure will be apparent from the following description and the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
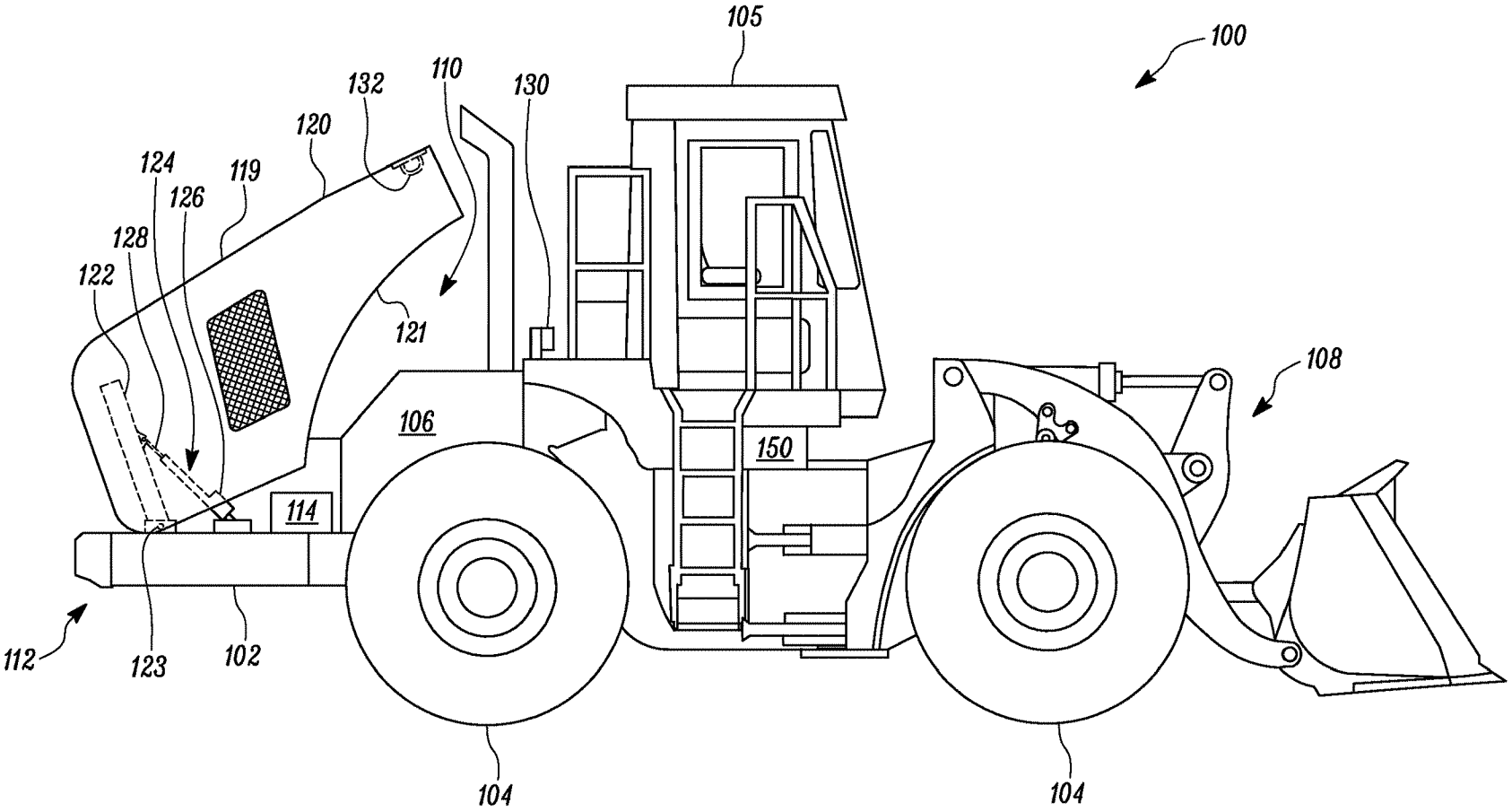
FIG. 1 is a side view of an exemplary machine having a hood shown in an opened position.

FIG. 1 shows a side view of an exemplary machine 100. In the illustrated embodiment, the machine 100 is a wheel loader. Although a wheel loader is disclosed, it should be noted that the machine 100 may alternatively be embodied in the form of a backhoe loader, an excavator, a dozer, an off-highway truck or other machines typically employed in applications such as mining, forestry, waste management, construction, agriculture, transportation, and the like. The present disclosure is generally relevant to any machine having a hood, as will become evident from the following description.

The machine 100 includes a frame 102 having a drive system (not shown) supported thereon for driving ground engaging members 104 of the machine 100. In the embodiment of FIG. 1, the ground engaging members 104 includes front wheels and rear wheels. It may also be contemplated that the ground engaging members 104 may be tracks.

The drive system includes a power source, such as an engine 106 configured to supply power to various components including, but not limited to, the ground engaging members 104 and an implement system 108. The engine 106 is located within an engine compartment 110 adjacent to a rear end 112 of the machine 100. The engine compartment 110 may include various components associated with the engine 106 such as, a radiator and a fuel injection pump, and others. In an embodiment, the engine 106 may be coupled to a generator (not shown) for generating electric power. The generator may be further coupled with one or more batteries 114 disposed adjacent to the engine compartment 110 of the machine 100. The batteries 114 may be configured to supply electric power to the various electric components and the lighting system of the machine 100 when the engine 106 is inoperative.

The machine 100 further includes a hood 120 configured to enclose the engine compartment 110 of the machine 100. The hood 120 may include an upper panel 119 and one or more side panels 121 extending from the upper panel 119. The upper panel 119 and the side panels 121 may be together configured to enclose the engine compartment 110. The hood 120 may further include one or more reinforcing members 122 to reinforce the structure of the upper panel 119 and the side panels 121 and to support the hood 120 on the frame 102 of the machine 100. The reinforcing members 122 may be welded or bolted on an inner surface of the upper panel 119 and the side panels 121 of the hood 120.

The hood 120 is moveable between an opened position (shown in FIG. 1) and a closed position. In the embodiment shown, a bottom end of the reinforcing members 122 attached to the side panels 121 may include a pivot pin member 123. The pivot pin member 123 is coupled on the frame 102 adjacent to the rear end 112 of the machine 100 such that the hood 120 may move between the closed position and the opened position about the pivot pin member 123. The hood 120 may be used for protecting the engine 106, the radiator, the fuel injection pump, the batteries 114 and other components associated with the engine 106 from water and dust within the engine compartment 110. Further, the hood 120 may also avoid physical contact of any external body with the components disposed within the engine compartment 110.

The machine 100 further includes an actuator, such as a linear actuator 124, configured to selectively move the hood 120 between the closed position and the opened position. The linear actuator 124 may be communicably coupled to the batteries 114 to receive an electric power therefrom. The linear actuator 124 includes a cylinder 126 for receiving a motor (not shown) therein. The motor may be configured to be in electric communication with the batteries 114 to receive required electric power to move the hood 120. The linear actuator 124 further includes a rod 128 movable between an extended position and a retracted position. The rod 128 may be engaged with the motor. Further, the rod 128 may move between the extended position and the retracted position upon actuation of the motor. A free end of the rod 128 is pivotally coupled to the reinforcing member 122 attached to the side panel 121 of the hood 120. A mounting end of the cylinder 126 is pivotally coupled to the frame 102 such that when the rod 128 moves towards the extended position, the hood 120 moves to the opened position. The retracted position of the rod 128 may generally correspond to the closed position of the hood 120. In other embodiments, the machine 100 may include two or more linear actuators 124 coupled between the hood 120 and the frame 102 to move the hood 120 between the opened position and the closed position.

The machine 100 further includes a latch member 130. The latch member 130 is switchable between a locked configuration and an unlocked configuration. In the locked configuration, the latch member 130 is configured to retain the hood 120 in the closed position thereof. In the unlocked configuration, the latch member 130 is configured to allow movement of the hood 120 from the closed position thereof. In the embodiment shown, the latch member 130 is disposed on the frame 102 within the engine compartment 110. An exemplary construction of the latch member 130 is described in detail later with reference to FIG. 2.

A striking pin 132 associated with the latch member 130 is mounted on the inner surface of the upper panel 119 to engage with the latch member 130 in the closed position of the hood 120. The striking pin 132 may be mounted on a reinforcing member (not shown) attached to the upper panel 119 of the hood 120. The striking pin 132 may be a rod adapted to be received within the latch member 130 in the closed position of the hood 120.

The machine 100 further includes a latch system 150 that is configured to be in communication with the hood 120 to move the hood 120 between the closed position and the opened position. Further, the latch system 150 is configured to selectively actuate the latch member 130 and the linear actuator 124 based on an input received from an operator. In the illustrated embodiment, the latch system 150 may be disposed on the frame 102 outside an operator cab 105 of the machine 100, as shown in FIG. 1. However, it may be contemplated that the latch system 150 may be disposed at any location of the frame 102 based on convenience of the operator to operate the latch system 150. In other embodiments, the latch system 150 may be disposed within the operator cab 105.

Figure 2:
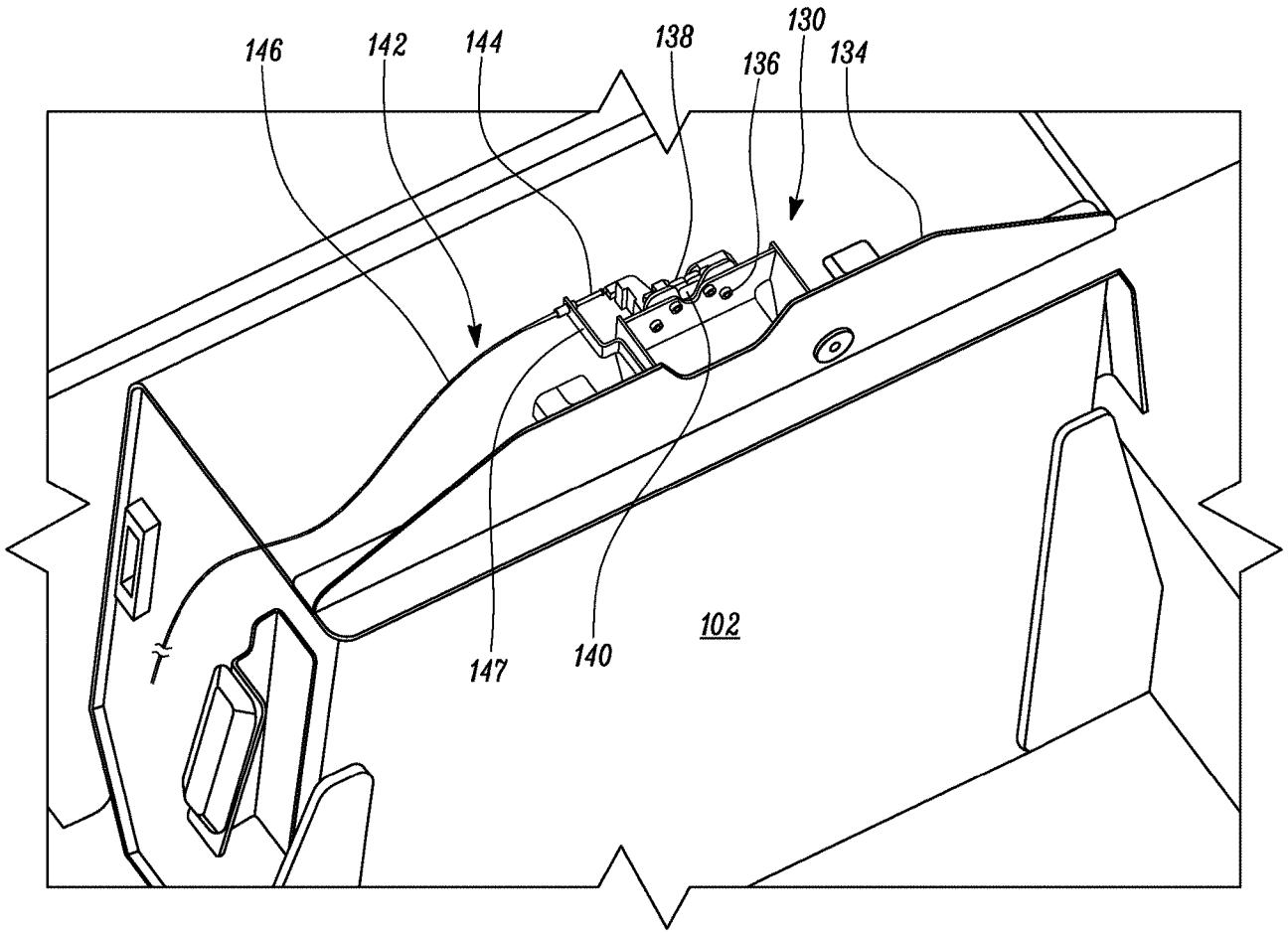
FIG. 2 is a perspective view of a latch member disposed on a frame of the machine.

FIG. 2 shows the latch member 130 that is mounted on the frame 102 of the machine 100. The latch member 130 is detachably mounted on a support member 134 via fastening members 136 such as bolts. The support member 134 is further mounted on the frame 102 of the machine 100 via fasteners (not shown). The latch member 130 further includes a pair of engaging members 138 configured to engage with the striking pin 132 in the closed position of the hood 120. The latch member 130 further includes a cable member 142 configured to actuate the pair of engaging members 138 and thereby to move the latch member 130 in the unlocked configuration. The cable member 142 includes a first end 144 configured to couple to the engaging members 138. Further, the cable member 142 is configured to be coupled between the latch member 130 and the latch system 150.

In the illustrated embodiment, the cable member 142 further includes a guiding member 146 for allowing the cable member 142 to move fore and aft therethrough. The support member 134 further includes a first bracket member 147 for supporting one end of the guiding member 146 adjacent to the first end 144 of the cable member 142. In an alternative embodiment, a linkage mechanism may be coupled between the latch system 150 and the latch member 130 for switching the latch member 130 to the unlocked configuration. The linkage mechanism may include one or more links coupled to each other. Further, the one or more links may move relative to each other to switch the latch member 130 in the unlocked configuration.

Figure 3:
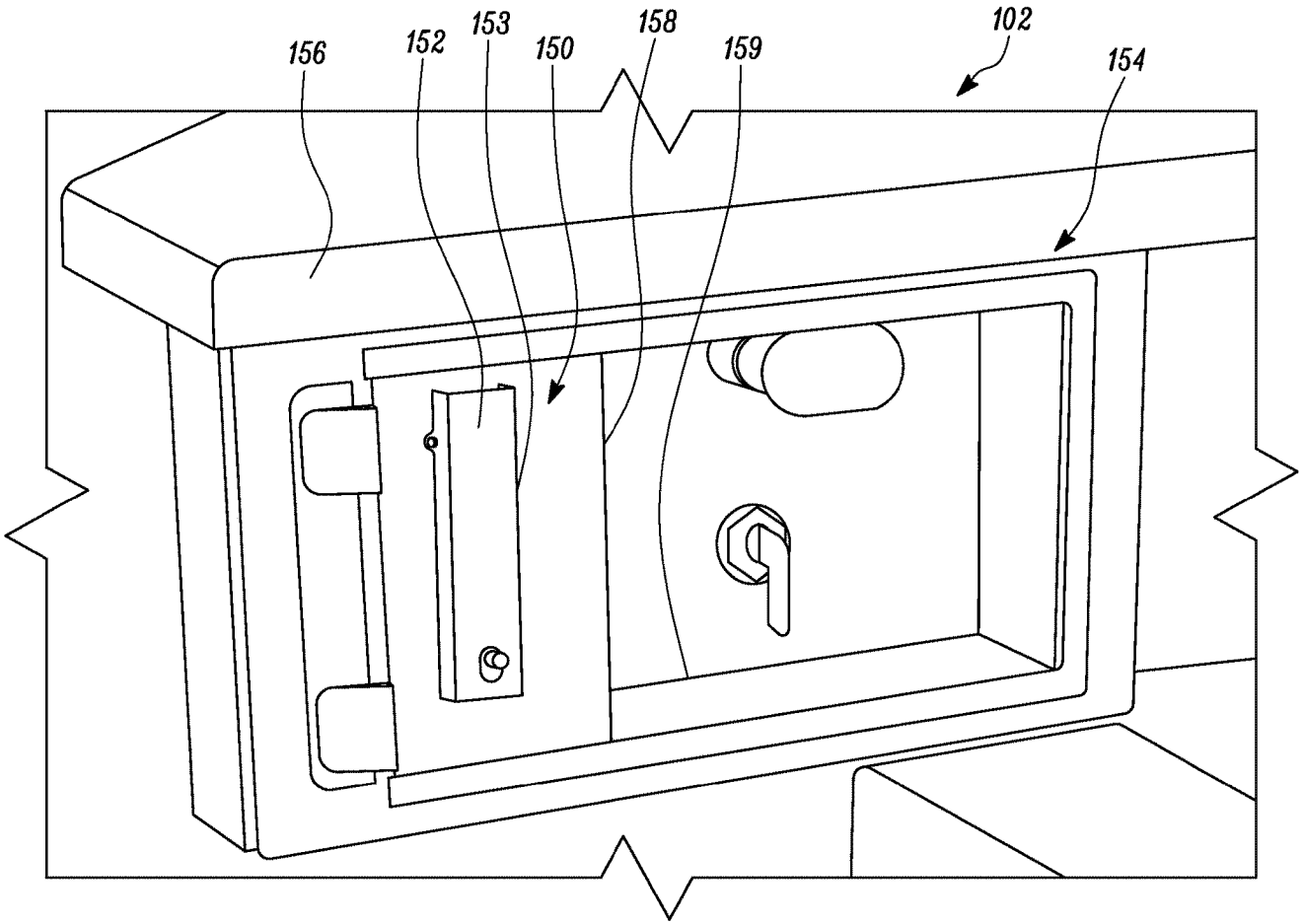
FIG. 3 is a perspective view showing an interlock lever associated with a latch system of the machine.

FIG. 3 illustrates a perspective view showing an interlock lever 152 associated with the latch system 150. The interlock lever 152 is configured to actuate the latch member 130 of the machine 100. The interlock lever 152 includes a body 153, which in the embodiment shown is movably coupled to the frame 102 of the machine 100. The body 153 is movable between a first position (FIG. 4) and a second position (FIG. 5). In the second position, the body 153 of the interlock lever 152 is configured to actuate the latch member 130 to allow the hood 120 to move from the closed position thereof.

In the illustrated embodiment, a box 154 is formed below a floor panel 156 of the machine 100. The box 154 includes a bottom plate 158 and a plurality of side plates 159 to define a hollow space along with an opening. The body 153 of the interlock lever 152 is movably coupled on the bottom plate 158 of the box 154. The hollow space may also include various machine operating switches, such as disposed on the bottom plate 158. The opening may give access to the operator to operate the interlock lever 152 and the various machine operating switches. The opening may be further closed by a door member (not shown) to enclose the interlock lever 152 when not in use. Moreover, the interlock lever 152 and the machine operating switches may be restricted from unauthorized use with the help of the door member.

Figure 4:
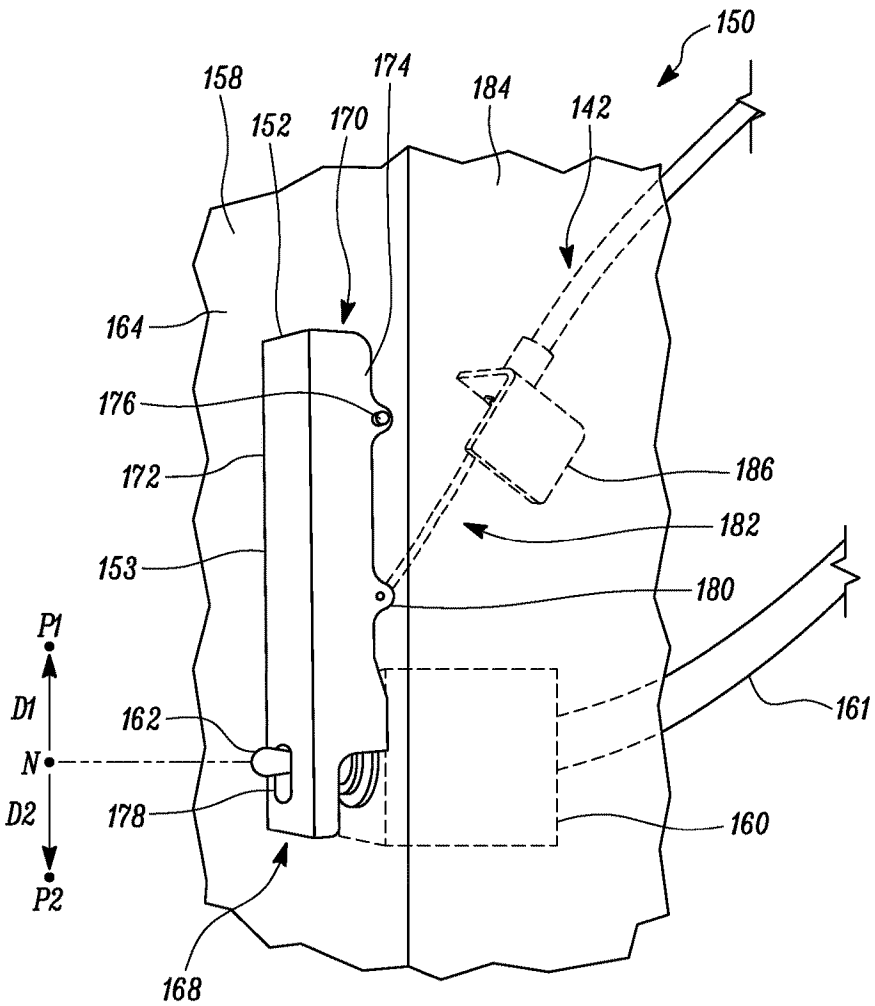
FIG. 4 is a view of the interlock lever of FIG. 3 shown in a first position thereof.
Figure 5:
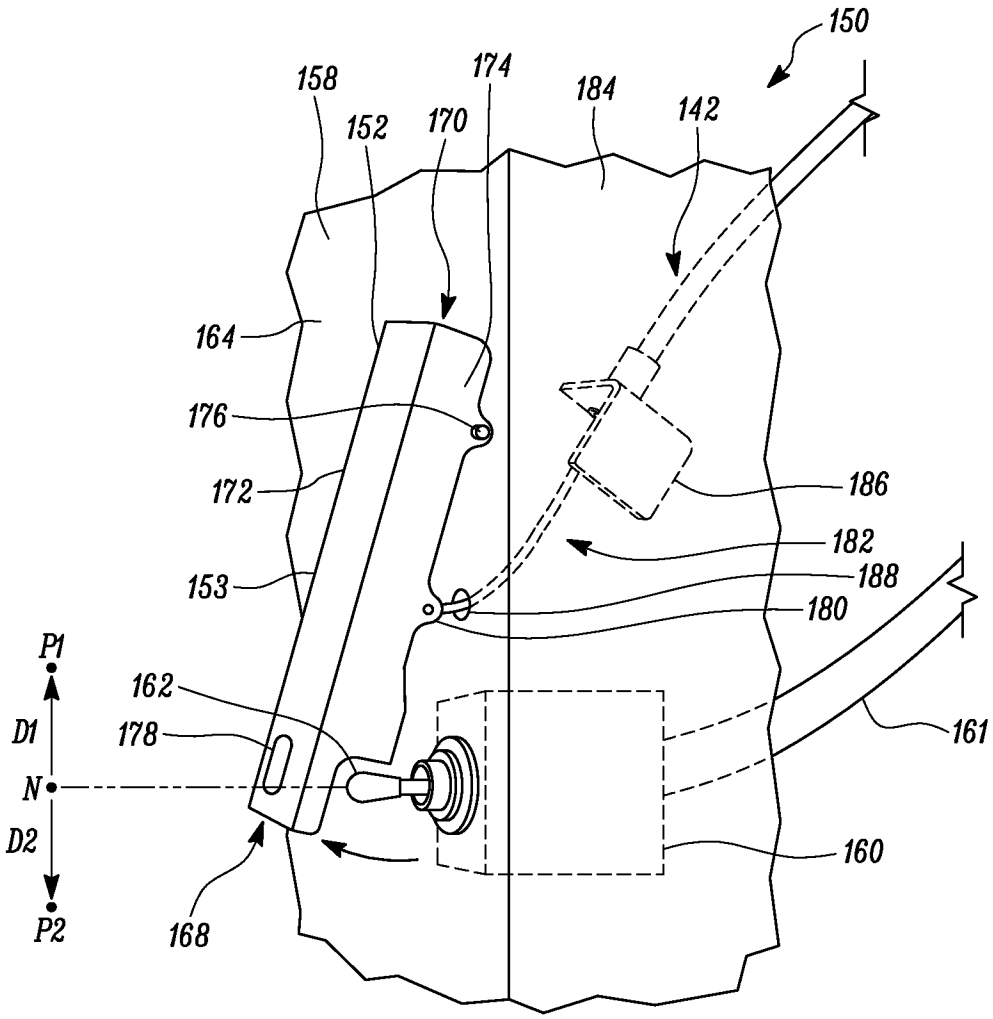
FIG. 5 is a view of the interlock lever of FIG. 3 shown in a second position thereof.

FIG. 4 illustrates a view of the interlock lever 152 shown in the first position thereof. In the first position, the interlock lever 152 is configured to engage with an input member 162 associated with the linear actuator 124 of the machine 100. The input member 162 is coupled to a switching device 160 to move the hood 120 between the closed position and the opened position based on a user input. The input member 162 is further configured to be movable in a first direction D1 to move the hood 120 towards the opened position and a second direction D2 opposite to the first direction D1 to move the hood 120 towards the closed position. The switching device 160 may be in electric communication with the batteries 114 and the linear actuator 124 via one or more cables 161.

In an embodiment, the input member 162 may also be configured to be in a neutral position N when not operated by the operator. Further, the input member 162 may also be configured to move to the neutral position N if the operator releases the input member 162 after moving to the first direction D1 or the second direction D2. In an example, the input member 162 may be a toggle switch.

The bottom plate 158 may include a through hole (not shown) to receive the input member 162 therethrough such that the switching device 160 may be mounted on the bottom plate 158. The switching device 160 is mounted on an inner surface of the bottom plate 158 via fastening members (not shown), such that the input member 162 may project from an outer surface 164 of the bottom plate 158.

The body 153 of the interlock lever 152 extends between a first end 168 and a second end 170. The body 153 may be formed from a metallic plate. In the illustrated embodiment, a cross section of the body 153 may be in a C shape defined by a base portion 172 and a pair of side portions 174. The interlock lever 152 includes a pivot member 176 configured to couple the body 153 of the interlock lever 152 to the frame 102. The body 153 of the interlock lever 152 is movably coupled to the bottom plate 158 via the pivot member 176. The body 153 is further movable between the first position and the second position about the pivot member 176 based on a user input. In the illustrated embodiment, the pivot member 176 is disposed between the side portions 174 adjacent to the second end 170 of the body 153.

The interlock lever 152 further includes a slot 178 defined in the body 153. In the illustrated embodiment, the slot 178 may be an elongate opening formed adjacent to the first end 168 along a length of the body 153. The slot 178 is configured to receive the input member 162 at the first position of the interlock lever 152. In the first position of the body 153, the slot 178 is configured to prevent movement of the input member 162 in the first direction D1 (FIG. 4). Further, in the second position of the body 153, the slot 178 is not engaged with the input member 162, which is free to be moved in both the first direction D1 and the second direction D2 (FIG. 5). Additionally, in the first position of the body 153, the slot 178 may be configured to allow movement of the input member 162 in the second direction D2 (FIG. 4).

In various embodiments, the body 153 of the interlock lever 152 may include a clamping member and a locking member instead of the slot 178 to prevent moving of the input member 162 in the first direction D1 in the first position of the interlock lever 152.

The interlock lever 152 further includes a coupling portion 180 defined in the body 153 between the pivot member 176 and the slot 178. The coupling portion 180 is configured to couple with a second end 182 of the cable member 142. Thus the cable member 142 is coupled between the interlock lever 152 and the latch member 130 to switch the latch member 130 in the unlocked configuration in the second position of the interlock lever 152. Further, the latch member 130 allows the hood 120 to move from the closed position. In the illustrated embodiment, the coupling portion 180 may be defined by the side portions 174 between the pivot member 176 and the slot 178. The bottom plate 158 further includes an intermediate side plate 184. A second bracket member 186 is disposed on the intermediate side plate 184 to support the guiding member 146 adjacent to the second end 182 of the cable member 142. Further, the bottom plate 158 may include an aperture 188 (shown in FIG. 5) to receive the second end 182 of the cable member 142 therethrough and to allow coupling of the cable member 142 with the coupling portion 180. It may be contemplated that the second bracket member 186 may be disposed at any location of the frame 102.

In an embodiment, an elastic member (not shown), such as a spring may be disposed between the interlock lever 152 and the bottom plate 158. The elastic member may be configured to retain the interlock lever 152 in the first position. Further, the interlock lever 152 may be moved to the second position against a biasing force of the elastic member.

INDUSTRIAL APPLICABILITY

The present disclosure relates to the latch system 150 for actuating the latch member 130 and for allowing actuation of the linear actuator 124 for moving the hood 120. The interlock lever 152 of the latch system 150 is moved to the second position by the operator to allow the hood 120 to move from the closed position before actuating the linear actuator 124. Actuation of the interlock lever 152 between the first position and the second position is described in detail herein below with reference to FIG. 5.

FIG. 5 illustrates a view of the interlock lever 152 shown in the second position thereof. When the operator wants to move the hood 120 to the opened position, the operator may move the interlock lever 152 from the first position towards the second position. As the interlock lever 152 moves towards the second position, the interlock lever 152 may pull the cable member 142 to actuate the engaging members 138 of the latch member 130 to the unlocked configuration. In the unlocked configuration, the striking pin 132 disengages from the latch member 130. Thus, in the second position of the interlock lever 152, the hood 120 may be moved from the closed position thereof. Further, in the second position of the interlock lever 152, the input member 162 is also disengaged from the slot 178 of the interlock lever 152. Thus the interlock lever 152 allows actuation of the input member 162 in both the first direction D1 and the second direction D2.

The operator may then move the input member 162 to the first direction D1. When the input member 162 moves to the first direction D1, an electric communication between the batteries 114 and the linear actuator 124 is established through the cables 161. The motor actuates the rod 128 to move to the extended position thereof. The operator may hold the input member 162 at a position P1 for a predetermined time to move the hood 120 to the opened position. The predetermined time may be an amount of time required for moving the hood 120 to the opened position from the closed position. In an example, the operator may hold the input member 162 for 30 seconds in the position P1 to move the hood 120 to the opened position. After the predetermined time, the operator may release the input member 162 to allow the input member 162 to move back to the neutral position N.

For moving the hood 120 from the opened position to the closed position, the operator may move the input member 162 in the second direction D2. When the input member 162 moves to a position P2 in the second direction D2, an electric communication between the batteries 114 and the linear actuator 124 may be established through the cables 161. The motor may further actuate the rod 128 to move to the retracted position thereof. The operator may hold the input member 162 at the position P2 for the predetermined time. After the predetermined time, the operator may release the input member 162 to allow the input member 162 to move back to the neutral position N. In the closed position of the hood 120, the striking pin 132 may be engaged with the engaging members 138 of the latch member 130. The striking pin 132 may engage with the engaging members 138 due to a force caused during movement of the rod 128 from the extended position to the retracted position. Thus the hood 120 is secured in the closed position in the latch member 130.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A latch system for a hood of a machine, the machine having an input member, the input member being movable in a first direction to cause the hood to move towards an opened position and a second direction to cause the hood to move towards a closed position, the latch system comprising:

a latch member moveable between a locked configuration and an unlocked configuration, wherein in the locked configuration the latch member retains the hood in the closed position thereof, and wherein in the unlocked configuration the latch member allows movement of the hood from the closed position thereof; and an interlock lever including a body, the interlock lever movable between a first position and a second position, wherein in the first position the body blocks movement of the input member in the first direction, and wherein in the second position, the body of the interlock lever does not block movement of the input member in the first direction, and wherein movement of the interlock lever from the first position to the second position moves the latch member to the unblocked position.

2. The latch system of claim 1, wherein in the first position of the interlock lever, the input member is configured to be moved in the second direction.

3. A latch system for a hood of a machine, the machine having an input member, the input member being moveable in a first direction to cause the hood to move towards an opened position and a second direction to cause the hood to move towards a closed position, the latch system comprising:

a latch member moveable between a locked configuration and an unlocked configuration, wherein in the locked configuration the latch member retains the hood in the closed position thereof, and wherein in the unlocked configuration the latch member allows movement of the hood from the closed position thereof; and an interlock lever defining a slot therethrough and being moveable between a first position and a second position, wherein in the first position the slot of the interlock lever blocks movement of the input member in the first direction, and wherein in the second position the interlock lever causes the latch member to move to the unlocked configuration thereof and allows movement of the input member in the first direction.

4. The latch system of claim 3, wherein in the first position of the interlock lever the slot allows movement of the input member in the second direction.

5. The latch system of claim 3, wherein the interlock lever comprises a pivot member to pivotally couple the interlock lever to a frame of the machine, and wherein the interlock lever is movable between the first position and the second position about the pivot member.

6. The latch system of claim 3, wherein the interlock lever further comprises a coupling portion defined between the pivot member and the slot.

7. The latch system of claim 6, further comprising a cable member coupled to the coupling portion of the interlock lever and the latch member, wherein in the second position of the interlock lever, the cable member actuates the latch member to the unlocked configuration thereof.

* * * * *